United States Patent [19]

Chew

[11] Patent Number: 4,635,720

[45] Date of Patent: Jan. 13, 1987

[54] HEAVY OIL RECOVERY PROCESS USING INTERMITTENT STEAMFLOODING

[75] Inventor: Ju-Nam Chew, Dallas, Tex.

[73] Assignee: Mobil Oil Corporation, New York, N.Y.

[21] Appl. No.: 816,094

[22] Filed: Jan. 3, 1986

[51] Int. Cl.[4] ..... E21B 43/30; E21B 43/24

[52] U.S. Cl. ..... 166/245; 166/263; 166/271; 166/272

[58] Field of Search ..... 166/245, 263, 272, 271, 166/303

[56] References Cited

U.S. PATENT DOCUMENTS

| | | | |
|---|---|---|---|
| 2,876,838 | 3/1959 | Williams | 166/272 X |
| 3,771,598 | 11/1973 | McBean | 166/272 X |
| 3,927,716 | 12/1975 | Burdyn et al. | 166/270 |
| 4,133,382 | 1/1979 | Cram et al. | 166/263 |
| 4,271,905 | 6/1981 | Redford et al. | 166/272 X |
| 4,324,291 | 4/1982 | Wong et al. | 166/272 X |
| 4,427,066 | 1/1984 | Cook | 166/263 X |
| 4,450,911 | 5/1984 | Shu et al. | 166/263 |
| 4,458,758 | 7/1984 | Hunt, III et al. | 166/272 |

*Primary Examiner*—George A. Suchfield

*Attorney, Agent, or Firm*—Alexander J. McKillop; Michael G. Gilman; Charles A. Malone

[57] ABSTRACT

This invention is a method for recovering viscous hydrocarbonaceous fluids from a subterranean formation containing one or more vertically extensive, narrow, high permeability conduits. At least one injection well communicates with at least one production well via said conduits. Steam is injected into said injection well until the water-oil ratio becomes excessive at the production well. The production well is then shut in until the formation is pressurized. Stem injection is then stopped and the production well is opened for production by pressure depletion. This cycle is repeated until oil recovery becomes uneconomical.

19 Claims, 4 Drawing Figures

HEAVY OIL RECOVERY PROCESS USING INTERMITTENT STEAMFLOODING

FIELD OF THE INVENTION

This invention relates to a thermal process for recovering oil from a subterranean, viscous oil-containing formation having at least one narrow high permeability channel between injection and production wells. More particularly, this invention relates to a thermal method of recovering oil from a viscous oil-containing formation employing a selective injection system for injecting steam into the formation and a sequence of manipulative steps with the steam to obtain maximum heat utilization and oil recovery from one or more spaced-apart production wells.

BACKGROUND OF THE INVENTION

Continued worldwide demand for petroleum products, combined with a high level of prices for petroleum and products recovered therefrom, has sustained interest in the sources of hydrocarbons which are less accessible than crude oil of the Middle East and other countries. Such hydrocarbonaceous deposits range from heavy oil to tar sands and to oil shale, found in western Canada and in the western United States. Depending on the type and depth of the deposit, recovery techniques range from steam injection to in-situ combustion to mining.

For heavy oils in the gravity range of 10 to 20 degrees API, steam injection has been a widely-applied method for oil recovery. Problems arise, however, when one attempts to apply the process to heavy oil reservoirs with very low transmissibility. In such cases, because of the unfavorable mobility ratios, steam channelling and gravity override often result in early steam breakthrough and leave a large portion of the reservoir unswept. The key to a successful steam flooding lies in striking a good balance between the rate of displacement and the rate of heat transfer which lowers the oil viscosity to a more favorable mobility ratio.

A more particular problem is presented when the oil-bearing formation contains vertical fractures or other conduits which are narrow in lateral extent. Where these conduits link injection wells with production wells, injected steam flows quickly to the production wells resulting in high water-oil ratios and low oil recovery. The problem is resolved with the instant invention.

SUMMARY OF THE INVENTION

This invention discloses a method for recovering hydrocarbonaceous fluids from a heavy oil-containing formation, which formation is penetrated by at least one vertical fracture or other conduit substantially narrow in lateral extent which provides flow-path communication between injection and production wells. In the practice of this invention, steam is injected into said formation via an injection well. Injection is continued until said steam breaks through at a production well, or until the water cut becomes excessive. The production well is then closed in. Steam injection is continued until the steam pressure in the vicinity of the production well is substantially that of the steam injection pressure at the injection well. When the steam pressure near the production well is substantially equal to the pressure of the injection well, steam injection is ceased and the injection well is shut-in. The production well is then opened to produce hydrocarbonaceous fluids by blowdown or pressure depletion until the oil production rate becomes too low. This cycle can be repeated until oil production becomes uneconomical.

It is therefore an object of this invention to avoid producing excessively high water/oil ratios after steam breakthrough when using an ordinary steamflood.

DESCRIPTION OF THE PREFERRED EMBODIMENT

Figure 1:
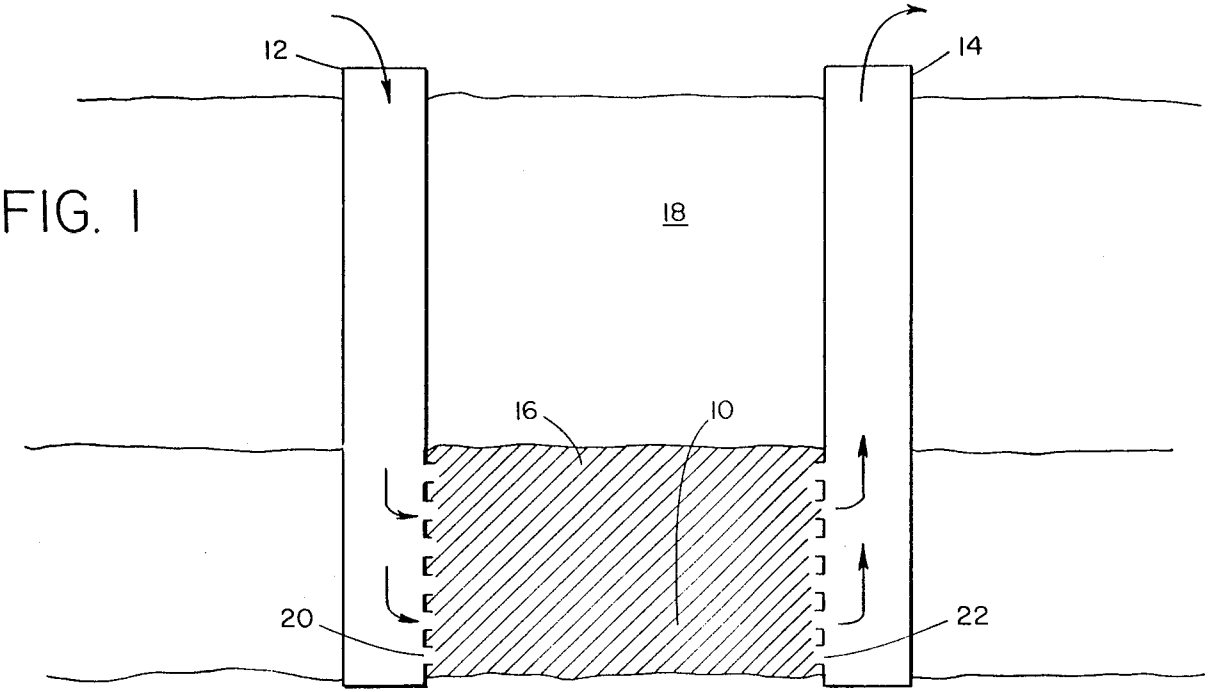
FIG. 1 is a schematic representation of an embodiment of this invention depicting a vertical fracture within the oil-bearing formation and this fracture providing a connection between the injection and production wells.
Figure 2:
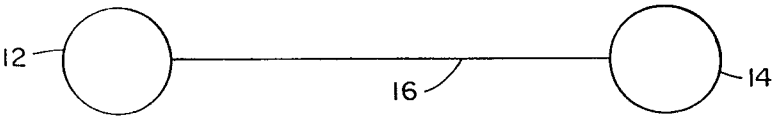
FIG. 2 is a top view of a fracture which is in communication with injection and production wells.
Figure 3:
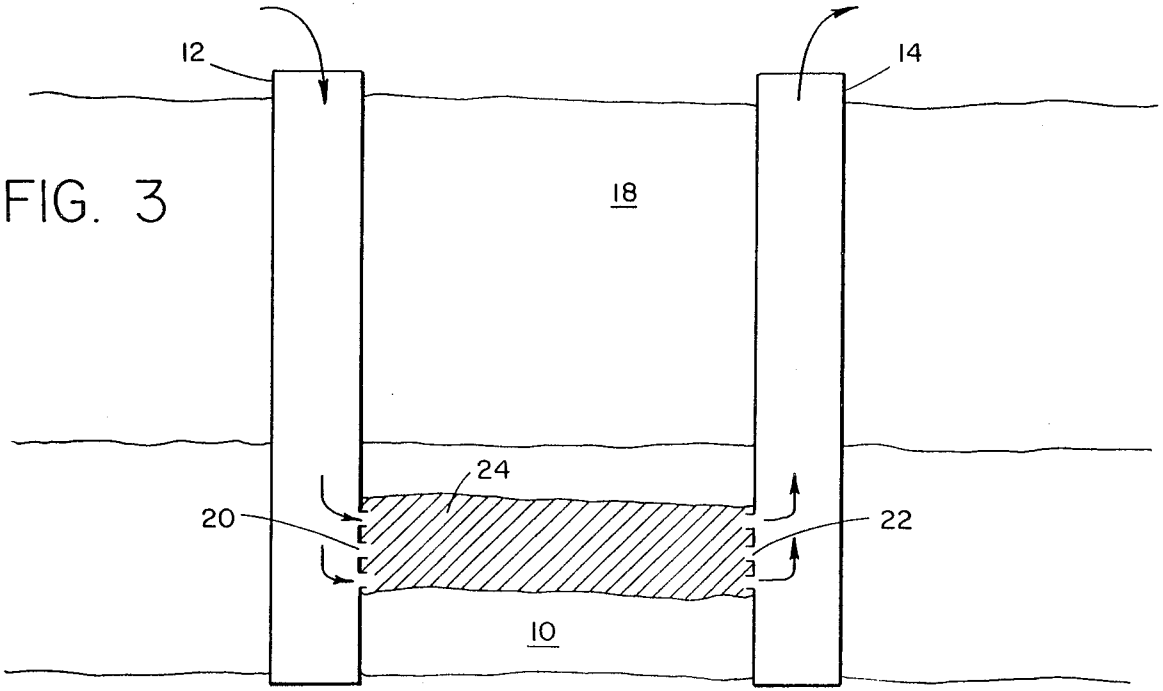
FIG. 3 is a schematic representation of another embodiment of this invention showing a high permeability conduit of narrow width within the oil-bearing formation and this conduit extending between the injection and production wells.
Figure 4:
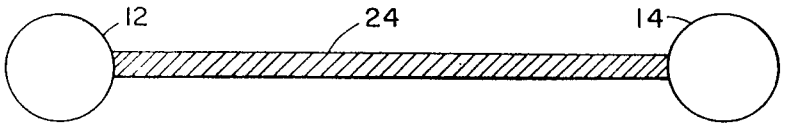
FIG. 4 is a top view of a high permeability conduit of narrow width which communicates with injection and production wells.

Referring to FIGS. 1 and 2, an injection well 12 penetrates a subterranean viscous oil-containing formation 10. This formation contains a vertical fracture 16 therein. Formation 10 contains either heavy, viscous oil or a tar sand deposit. Where heavy, viscous oils are encountered in the formation 10, the gravity range will be about 9 to 20 degrees API. In order to remove hydrocarbonaceous fluids from the formation via the vertical fracture 16, steam is injected into injection well 12 where it enters the formation 10 via perforations 20 and goes into vertical fracture 16 or into a conduit 24, as shown in FIGS. 3 and 4, which is narrow in lateral extent. Said conduit usually does not penetrate the entire vertical height of the formation and said fracture may not be completely vertical. Steam is continually injected into injection well 12 and into the formation where reservoir fluids are produced from production well 14 via perforations 22 until steam breakthrough occurs or until the water cut becomes excessive. Steam pressure which is injected into the formation via injection well 12 is maintained usually below the overburden 18 pressure of the formation. When steam breakthrough occurs or the water cut becomes excessive in production well 14, the production well 14 is shut in. While production well 14 is shut in, steam injection continues via injection well 12 until the pressure in the formation 10 near production well 14 approaches the steam injection pressure.

When the steam injection pressure near production well 14 is about the same as the steam injection pressure, injection well 12 is shut in and hydrocarbonaceous fluids are produced from production well 14 by "blowdown" until the oil rate falls below the desired value. The process is repeated until oil production becomes too low.

In another embodiment, the process above can be applied to a multi-well pattern as described in U.S. Pat. No. 3,927,716 issued to Burdyn et al., and which is hereby incorporated by reference. Another multi-well pattern is described in U.S. Pat. No. 4,458,758 which issued to Hunt et al., and which is hereby incorporated by reference. In the practice of this embodiment each production well is shut in when steam breaks through to it or later, when its the water cut becomes excessive. While awaiting steam breakthrough to the other production wells, steam injection is continued. When all the production wells have been shut in, and the reservoir pressure approaches the steam injection pressure, the injection well(s) can be shut in. Afterwards, each production well is produced by "blowdown" until the oil rate falls below the desired value, at which point that well is shut in. After all the production wells have been shut in because of low oil rates or excessive water-oil ratios, the cycle of steam injection, shut in and oil production is repeated until recovery becomes uneconomical.

The single vertical fracture of single conduit may be replaced by a family of such fractures or conduits in the approximate path between the injection and production wells. Also, these high permeability fractures or conduits do not have to connect directly with the wells—only close enough to provide an easy fluid flow path.

The following example shows results obtained by a computer simulation test.

EXAMPLE

For a one foot wide, vertically extensive, high permeability channel in a reservoir segment of 50 ft. wide, 467 ft. long and 16.03 ft. thick containing an oil of 4,000 centipoises at 77° F., and a density of 60.6 lb./ft.$^3$, a computer simulation showed the following oil recoveries:

| At End of Cycle No. | Cumulative Oil Recovery % of Original Oil in Place |
|---|---|
| 1 | 7.90 |
| 2 | 24.2 |
| 3 | 37.6 |
| 4 | 56.2 |

Other properties were:

| | High Permeability Channel | Formation |
|---|---|---|
| Horizontal Permeability | 160.2 darcies | 1.3 darcies |
| Vertical/Horizontal Permeability Ratio | 0.000812 | 0.10 |
| Original Oil Saturation | 0.30 | 0.65 |
| Original Water Saturation | 0.65 | 0.30 |
| Depth to Middle of Formation | 1458 ft | |
| Initial Formation Pressure | 530 psi | |
| Steam Pressure | 1200 psia | |
| Steam Injection Rate | 200 barrels (CWE)* 1 day | |

*Cold Water Equivalent

A cycle was completed when the oil rate during blowdown, declined to about 10 barrels/day or less. The four cycles were completed in a simulated time span of 460 days. Initial steam breakthrough occurred in 2.0 days. This recovery process has been verified in an actual field test.

In heavy oil reservoirs where high permeability zones such as vertical fractures or narrow conduits do not exist, they can be created by fracturing the formation or reservoir with steam. Of course, other fracturing or boring means may be utilized as is known to those skilled in the art. When such vertical fractures or narrow channels do exist, this process affords a practical way to recover hydrocarbonaceous fluids, since ordinary steamflooding is not effective with vertical fractures or narrow conduits. As is known to those skilled in the art, if necessary, steam stimulation may be used to establish initial thermal communication between wells.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the claims.

What is claimed is:

1. A steam flood method for recovering hydrocarbonaceous fluids from a subterranean, oil-bearing formation containing one or more substantially vertical fractures which formation is penetrated by at least one injection well which communicates via said fracture with at least one production well comprising:

(a) injecting steam into said formation via an injection well until steam, along with hydrocarbonaceous fluids, breaks through at said production well;

(b) shutting in said production well while continuing steam injection into said injection well until the steam pressure near said production well is substantially the same as said pressure at the injection well; and (c) shutting in said injection well and producing hydrocarbonaceous fluids from said production well.

2. The method as recited in claim 1 where the steam is injected into said injection well at a pressure below the overburden pressure of the formation.

3. The method as recited in claim 1 where steps (a), (b), and (c) are repeated until the ratio of oil to water becomes substantially low.

4. The method as recited in claim 1 wherein multiple injection wells are injected with steam and at least one production well is used.

5. The method as recited in claim 1 where at least one injection well is adjusted with steam and multiple production wells are used.

6. The method as recited in claim 1 where the vertical fractures are created by first injecting steam at high pressures or by other fracture-producing means.

7. The method as recited in claim 1 where the oil in the formation is in the gravity range of 9 to 18 degrees A.P.I.

8. A steam flood method for recovering hydrocarbonaceous fluids from a subterranean, oil-bearing formation containing one or more narrow, vertically extensive high permeability zones which formation is penetrated by at least one injection well which communicates via said high permeability zone with at least one production well comprising:

(a) injecting steam into said formation via an injection well until steam, along with hydrocarbonaceous fluids, breaks through at said production well;

(b) shutting in said production well while continuing steam injection into said injection well until the steam pressure near said production well is substantially the same as said pressure at the injection well; and (c) shutting in said injection well and producing hydrocarbonaceous fluids from said production well.

9. The method as recited in claim 8 where the steam is injected into said injection well at pressures below the overburden pressure of the formation.

10. The method as recited in claim 8 where steps (a), (b), and (c) are repeated until the ratio of oil to water becomes substantially low.

11. The method as recited in claim 8 where multiple injection wells are injected with steam and at least one production well is shut in when hydrocarbonaceous fluids are produced from the others.

12. The method as recited in claim 8 where multiple injection wells are injected with steam and multiple production wells are used.

13. The method as recited in claim 8 where the oil in the formation is in the gravity range of about 9 to about 18 degrees A.P.I.

14. A steam flood method for recovering hydrocarbonaceous fluids from a subterranean, oil-bearing formation containing one or more high permeability conduits which formation is penetrated by at least one injection well which communicates via said conduit with at least one production well comprising:

(a) injecting steam into said formation via an injection well until steam, along with hydrocarbonaceous fluids, breaks through at said production well;

(b) shutting in said production well while continuing steam injection into said injection well until the steam pressure near said production well is substantially the same as said pressure at the injection well; and (c) shutting in said injection well and producing hydrocarbonaceous fluids from said production well.

15. The method as recited in claim 14 where the steam is injected into said injection well at pressures below the overburden pressure of the formation.

16. The method as recited in claim 14 where steps (a), (b), and (c) are repeated until the ratio of oil to water becomes substantially low.

17. The method as recited in claim 14 where multiple injection wells are injected with steam and at least one production well is shut in while hydrocarbonaceous fluids are produced therefrom.

18. The method as recited in claim 14 where multiple injection wells are injected with steam and multiple production wells are used.

19. The method as recited in claim 14 where the oil in the formation is in the gravity range of about 9 to about 18 degrees A.P.I.

* * * * *